US011618938B2

(12) United States Patent
Harada et al.

(10) Patent No.: US 11,618,938 B2
(45) Date of Patent: Apr. 4, 2023

(54) STEEL SHEET HAVING A HOT-DIP ZN—AL—MG-BASED COATING FILM EXCELLENT IN TERMS OF SURFACE APPEARANCE AND METHOD OF MANUFACTURING THE SAME

(71) Applicant: JFE Steel Corporation, Tokyo (JP)

(72) Inventors: Hiroki Harada, Chiyoda-ku (JP); Kazuhisa Okai, Chiyoda-ku (JP); Hiroshi Kajiyama, Chiyoda-ku (JP)

(73) Assignee: JFE Steel Corporation, Tokyo (JP)

( * ) Notice: Subject to any disclaimer, the term of this patent is extended or adjusted under 35 U.S.C. 154(b) by 260 days.

(21) Appl. No.: 16/627,456

(22) PCT Filed: Jun. 6, 2018

(86) PCT No.: PCT/JP2018/021673
§ 371 (c)(1),
(2) Date: Dec. 30, 2019

(87) PCT Pub. No.: WO2019/009003
PCT Pub. Date: Jan. 10, 2019

(65) Prior Publication Data

US 2021/0147971 A1 May 20, 2021

(30) Foreign Application Priority Data

Jul. 5, 2017 (JP) ..... JP2017-131676
Jul. 5, 2017 (JP) ..... JP2017-131677

(51) Int. Cl.

| | |
|---|---|
| ***C23C 16/00*** | (2006.01) |
| ***C23C 2/06*** | (2006.01) |
| ***C22C 18/04*** | (2006.01) |
| ***C23C 2/28*** | (2006.01) |
| ***C23C 2/40*** | (2006.01) |
| ***C23C 22/78*** | (2006.01) |
| ***C23C 28/00*** | (2006.01) |
| ***C23C 2/26*** | (2006.01) |
| ***C23C 22/42*** | (2006.01) |
| ***C23C 2/14*** | (2006.01) |

(52) U.S. Cl.
CPC ..... *C23C 2/06* (2013.01); *C22C 18/04* (2013.01); *C23C 2/14* (2013.01); *C23C 2/26* (2013.01); *C23C 2/28* (2013.01); *C23C 2/40* (2013.01); *C23C 22/42* (2013.01); *C23C 22/78* (2013.01); *C23C 28/00* (2013.01); *C23C 28/321* (2013.01)

(58) Field of Classification Search
None
See application file for complete search history.

(56) References Cited

U.S. PATENT DOCUMENTS

| | | | | |
|---|---|---|---|---|
| 5,648,177 | A | 7/1997 | Yasushi et al. | |
| 6,709,770 | B2 | 3/2004 | Komatsu et al. | |
| 2015/0072166 | A1* | 3/2015 | Nakano | C23C 28/345 428/623 |
| 2018/0237897 | A1* | 8/2018 | Hashimoto | B32B 15/017 |
| 2019/0010595 | A1* | 1/2019 | Oh | C23C 2/26 |

FOREIGN PATENT DOCUMENTS

| | | | |
|---|---|---|---|
| CN | 1135537 | A | 11/1996 |
| EP | 2857544 | A1 | 4/2015 |
| JP | 10-226865 | A | 8/1998 |
| JP | 10-265926 | A | 10/1998 |
| JP | 10-306357 | A | 11/1998 |
| JP | 2003-003238 | A | 1/2003 |
| JP | 2006-348332 | A | 12/2006 |
| JP | 2013-241666 | A | 12/2013 |
| TW | 201343963 | A | 11/2013 |
| WO | 2001/59171 | A | 8/2001 |
| WO | 2016/162982 | A1 | 10/2016 |

OTHER PUBLICATIONS

Chinese Office Action dated Apr. 2, 2021, of counterpart Chinese Application No. 201880042953.0, along with a Concise Statement of Office Action in English.
Taiwanese Office Action dated Jul. 2, 2019, of counterpart Taiwanese Application No. 107120098, along with a Concise Statement of Office Action in English.
Japanese Office Action dated Aug. 20, 2019, of counterpart Japanese Application No. 2018-541375, along with a Concise Statement of Office Action in English.
Australian Office Action dated Oct. 9, 2020, of counterpart Australian Application No. 2018297757.

* cited by examiner

*Primary Examiner* — David P Turocy
(74) *Attorney, Agent, or Firm* — DLA Piper LLP (US)

(57) ABSTRACT

A steel sheet has a hot-dip Zn—Al—Mg-based coating film, the coating film containing 1 mass % to 22 mass % of Al and 0.1 mass % to 10 mass % of Mg on a surface of the steel sheet, in which an X-ray diffraction peak intensity ratio of a Mg—Zn compound phase in the coating film, that is, $MgZn_2/Mg_2Zn_{11}$, is 0.2 or less.

8 Claims, No Drawings

STEEL SHEET HAVING A HOT-DIP ZN—AL—MG-BASED COATING FILM EXCELLENT IN TERMS OF SURFACE APPEARANCE AND METHOD OF MANUFACTURING THE SAME

TECHNICAL FIELD

This disclosure relates to a steel sheet having a hot-dip Zn—Al—Mg-based coating film excellent in terms of surface appearance and a method of manufacturing the steel sheet.

BACKGROUND

Surface-treated steel sheets such as a galvanized steel sheet that are excellent in terms of corrosion resistance are used in a wide range of industrial fields including automobiles, electrical appliances, and building materials. Moreover, recently, since there has been an increasing demand for use of surface-treated steel sheets in harsh, corrosive outdoor environments, a steel sheet having a hot-dip Zn—Al—Mg-based coating film, in which corrosion resistance is improved to a higher level by adding aluminum (Al) and magnesium (Mg) to zinc (Zn), has been proposed (for example, Japanese Unexamined Patent Application Publication No. 10-226865).

However, the above-mentioned steel sheet having a hot-dip Zn—Al—Mg-based coating film has a problem regarding surface appearance. In a steel sheet having a hot-dip Zn—Al—Mg-based coating film, a $MgZn_2$ phase is mainly crystallized as a Mg—Zn compound phase in the coating film. Further, a $Mg_2Zn_{11}$ phase is locally crystallized therein and generates a black spotty pattern (hereinafter, referred to as "black spots"), which is regarded as a problem. Therefore, JP '865 proposes a technique of inhibiting a $Mg_2Zn_{11}$ phase from being crystallized by controlling the cooling rate. In addition, Japanese Unexamined Patent Application Publication No. 10-306357 proposes a technique of inhibiting a $Mg_2Zn_{11}$ phase from being crystallized by adding Ti, B, and so forth to a coating bath.

However, even when the above-described techniques are used, it is not possible to completely inhibit black spots from being generated depending on manufacturing conditions (regarding steel sheet thickness, coating weight, steel sheet passing speed and so forth).

It could therefore be helpful to provide a steel sheet having a hot-dip Zn—Al—Mg-based coating film excellent in terms of surface appearance and a method of manufacturing the steel sheet.

SUMMARY

We found that it is possible to manufacture a steel sheet having a hot-dip Zn—Al—Mg-based coating film excellent in terms of surface appearance without black spots by controlling the phase structure of a coating film formed of a Zn phase, an Al phase, and a Mg—Zn compound phase so that the X-ray intensity ratio of a $MgZn_2$ phase to a $Mg_2Zn_{11}$ phase in the Mg—Zn compound phase is 0.2 or less.

We thus provide:

[1] A steel sheet having a hot-dip Zn—Al—Mg-based coating film, the coating film containing 1 mass % to 22 mass % of Al and 0.1 mass % to 10 mass % of Mg on a surface of the steel sheet, in which an X-ray diffraction peak intensity ratio of a Mg—Zn compound phase in the coating film, that is, $MgZn_2/Mg_2Zn_{11}$, is 0.2 or less.

[2] The steel sheet having a hot-dip Zn—Al—Mg-based coating film according to item [1], the coating film further containing 0.005 mass % to 0.25 mass % of Ni.

[3] The steel sheet having a hot-dip Zn—Al—Mg-based coating film according to item [1] or [2], the coating film being further coated with an inorganic compound-based film having a coating weight per side of 0.1 $g/m^2$ to 10 $g/m^2$.

[4] The steel sheet having a hot-dip Zn—Al—Mg-based coating film according to item [1] or [2], the coating film being further coated with an organic resin-based film having a coating weight per side of 0.1 $g/m^2$ to 10 $g/m^2$.

[5] The steel sheet having a hot-dip Zn—Al—Mg-based coating film according to item [1] or [2], the coating film being further coated with an inorganic compound-organic resin composite film having a coating weight per side of 0.1 $g/m^2$ to 10 $g/m^2$.

[6] A method of manufacturing a steel sheet having a hot-dip Zn—Al—Mg-based coating film, the method including: dipping a base steel sheet in a coating bath containing 1 mass % to 22 mass % of Al and 0.1 mass % to 10 mass % of Mg to form a hot-dip Zn—Al—Mg-based coating film, performing primary cooling on the steel sheet coated with the hot-dip Zn—Al—Mg-based coating film to a primary cooling stop temperature of lower than 300° C., heating the cooled steel sheet to a heating temperature of 280° C. or higher and 340° C. or lower, and performing secondary cooling on the heated steel sheet.

[7] The method of manufacturing a steel sheet having a hot-dip Zn—Al—Mg-based coating film according to item [6], in which the primary cooling stop temperature is 200° C. or lower, and in which the heating temperature is 300° C. or higher and 340° C. or lower.

[8] The method of manufacturing a steel sheet having a hot-dip Zn—Al—Mg-based coating film according to item [6] or [7], in which the heating following the primary cooling and the secondary cooling are performed so that the relational expression (1) below is satisfied.

$$18 \leq \tfrac{1}{2} \times (A-250) \times t \leq 13500 \quad (1)$$

where A: heating temperature (° C.) following the primary cooling and t: time (seconds) for which the steel sheet has a temperature of 250° C. or higher in a process from the heating following the primary cooling to the secondary cooling.

[9] The method of manufacturing a steel sheet having a hot-dip Zn—Al—Mg-based coating film according to any one of items [6] to [8], in which the coating bath further contains 0.005 mass % to 0.25 mass % of Ni.

[10] The method of manufacturing a steel sheet having a hot-dip Zn—Al—Mg-based coating film according to any one of items [6] to [9], the method further including performing a chemical conversion treatment after the secondary cooling has been performed to form any one of an inorganic compound-based film, an organic resin-based film, and an inorganic compound-organic resin composite film on a surface of the coating film.

Our steel sheet having a hot-dip Zn—Al—Mg-based coating film, for example, includes a steel sheet having a Zn—Al—Mg coating film, a steel sheet having a Zn—Al—Mg—Ni coating film, and a steel sheet having a Zn—Al—Mg—Si coating film. A hot-dip Zn—Al—Mg-based coating film is not limited to these examples and may be applied to any one of the known hot-dip Zn—Al—Mg-based coating films containing Zn, Al, and Mg. In addition, "%" used when representing the chemical composition of steel or a coating film always refers to "mass %."

It is thus possible to manufacture a steel sheet having a hot-dip Zn—Al—Mg-based coating film excellent in terms of surface appearance without black spots.

DETAILED DESCRIPTION

First, the reasons for the limitations of the chemical composition of the coating film of the steel sheet having a hot-dip Zn—Al—Mg-based coating film will be described hereafter.

The coating film is a coating film containing 1 mass % to 22 mass % of Al and 0.1 mass % to 10 mass % of Mg.

Al: 1 Mass % to 22 Mass %

Al is added to improve corrosion resistance. It is not possible to achieve sufficient corrosion resistance when the Al content in a coating film is less than 1%. In addition, since a Zn—Fe alloy phase grows at a coating layer-base steel interface, there is a significant deterioration in workability. On the other hand, when the Al content is more than 22%, the effect of improving corrosion resistance becomes saturated. Therefore, the Al content is 1% to 22% or preferably 4% to 15%.

Mg: 0.1 Mass % to 10 Mass %

Mg is, like Al, added to improve corrosion resistance. It is not possible to achieve sufficient corrosion resistance when the Mg content in a coating film is less than 0.1%. On the other hand, when the Mg content is more than 10%, the effect of improving corrosion resistance becomes saturated. In addition, Mg oxide-based dross tends to be formed. Therefore, the Mg content is 0.1% to 10%. In addition, even when the Mg content in a coating film is less than the above-described upper limit, when the Mg content is more than 5%, $MgZn_2$ may be locally crystallized in the form of a primary crystal in a coating film after the primary cooling has been performed. $MgZn_2$, which is crystallized in the form of a primary crystal, tends to have a comparatively large grain diameter, and it is necessary to perform a heating treatment, which is performed to promote the below-described solid-phase transformation from a $MgZn_2$ phase into a $Mg_2Zn_{11}$ phase, for a long time. Therefore, it is preferable that the Mg content be 5% or less or more preferably 3% or less.

In addition to the elements described above, the coating film may further contain Ni, Si and so forth.

Ni: 0.005 Mass % to 0.25 Mass %

When Ni is added, it is preferable that the Ni content be 0.005% to 0.25%. When a steel sheet having a hot-dip Zn—Al—Mg-based coating film is stored in a harsh corrosive environment such as a high-temperature and high-humidity environment for a long time, there may be a phenomenon called "blackening" in which the color of the surface of the coating film changes into gray or black due to the oxidation of the surface, occurs. However, it is possible to improve blackening resistance by adding Ni. There is an improvement in blackening resistance to a higher level when the Ni content is 0.005% or more. When the Ni content is more than 0.25%, since dross is formed in a coating bath, there may be a deterioration in surface appearance due to adherence of the dross. Moreover, when the structure of a Mg—Zn compound phase in a coating film is changed from that containing mainly a $MgZn_2$ phase to that containing mainly a $Mg_2Zn_{11}$ phase by performing heating as described below, there may be a deterioration in blackening resistance. By adding Ni in a coating film, it is possible to inhibit a deterioration in blackening resistance due to a change in the structure of a Mg—Zn compound phase in the coating film.

In addition, when Si is added, it is preferable that the Si content be 0.01% to 0.5%. Si is added to improve corrosion resistance, and it is not possible to realize the effect of improving corrosion resistance when the Si content is less than 0.01%. Since dross is formed in a coating bath, there may be a deterioration in surface appearance when the Si content is more than 0.5%.

Hereafter, the features of the phase structure of the coating film ("coating phase structure" or more simply "phase structure") of the steel sheet having a hot-dip Zn—Al—Mg-based coating film will be described. The coating film of the steel sheet having a hot-dip Zn—Al—Mg-based coating film is composed mainly of a Zn phase, an Al phase, and a Mg—Zn compound phase. However, a conventionally proposed Mg—Zn compound phase of a steel sheet having a hot-dip Zn—Al—Mg-based coating film is formed mainly in the form of a $MgZn_2$ phase.

In contrast, the steel sheet having a hot-dip Zn—Al—Mg-based coating film is characterized by forming a Mg—Zn compound phase mainly in the form of a $Mg_2Zn_{11}$ phase. We found that, by crystallizing a predetermined amount of a $Mg_2Zn_{11}$ phase, which is locally crystallized in conventional techniques throughout the whole coating film, it is possible to manufacture a steel sheet having a hot-dip Zn—Al—Mg-based coating film without black spots. It is possible to determine the proportions of a $MgZn_2$ phase and a $Mg_2Zn_{11}$ phase by performing X-ray diffractometry. Then, by controlling the X-ray intensity ratio of $MgZn_2/Mg_2Zn_{11}$, which is an X-ray diffraction peak intensity ratio, that is, $MgZn_2/Mg_2Zn_{11}$, to be 0.2 or less, it is possible to manufacture a steel sheet having a hot-dip Zn—Al—Mg-based coating film excellent in terms of surface appearance without black spots. It is preferable that the X-ray diffraction peak intensity ratio, that is, $MgZn_2/Mg_2Zn_{11}$, be 0.1 or less.

Hereafter, the method of manufacturing the steel sheet having a hot-dip Zn—Al—Mg-based coating film will be described.

The method includes dipping a base steel sheet in a coating bath containing 1 mass % to 22 mass % of Al and 0.1 mass % to 10 mass % of Mg to form a hot-dip Zn—Al—Mg-based coating film, performing primary cooling on the steel sheet coated with the hot-dip Zn—Al—Mg-based coating film to a primary cooling stop temperature of lower than 300° C., heating the cooled steel sheet to a heating temperature of 280° C. or higher and 340° C. or lower, and performing secondary cooling on the heated steel sheet.

Although the steel sheet having a hot-dip Zn—Al—Mg-based coating film may be subjected to heating following primary cooling and secondary cooling by using batch processing, it is preferable that the steel sheet be manufactured by using a continuous galvanizing line (CGL).

Coating Treatment

The coating bath contains 1% to 22% of Al and 0.1% to 10% of Mg. This is for the purpose of obtaining a steel sheet having a hot-dip Zn—Al—Mg-based coating film containing 1% to 22% of Aland 0.1% to 10% of Mg. Moreover, 0.005% to 0.25% of Ni may also be added. In addition, 0.01% to 0.5% of Si may also be added.

The Al content and Mg content in the coating bath are almost equal to the respective Al content and Mg content in the coating film. Therefore, the chemical composition of the coating bath is controlled to achieve the desired chemical composition of the coating film. The remaining constituents of the coating bath are Zn and inevitable impurities.

Although there is no particular limitation on the temperature of the coating bath, it is preferable that the temperature be lower than 470° C. When the temperature is 470° C. or higher, since formation of an interface alloy phase is promoted, there may be a deterioration in workability.

Primary Cooling

The steel sheet coated with the hot-dip Zn—Al—Mg-based coating film is cooled to a primary cooling stop temperature of lower than 300° C. Phase transformation from a $MgZn_2$ phase into a $Mg_2Zn_{11}$ phase is made to occur in the subsequent process, that is, the heating treatment, as described below. To make such a phase transformation occur, it is necessary that the coating film be completely solidified so that a $MgZn_2$ phase is crystallized before the heating treatment is performed. The solidification temperature of the hot-dip Zn—Al—Mg-based coating film is about 340° C. When a cooling rate in the primary cooling after the coating treatment is high, since supercooling occurs, the coating film may be kept in a molten state, even at a temperature equal to or lower than the solidification temperature. Therefore, it is necessary that the coated steel sheet be cooled to a temperature of lower than the solidification temperature before the heating treatment is performed. Therefore, it is necessary that the coated steel sheet be cooled to a cooling stop temperature of lower than 300° C. before the heating treatment is performed so that the coating film is completely solidified. For the reasons described above, the primary cooling stop temperature is set to be lower than 300° C., preferably 250° C. or lower, or more preferably 200° C. or lower. There is no particular limitation on the cooling rate in the primary cooling. It is preferable that the cooling rate be 10° C./s or more from the viewpoint of productivity. When the cooling rate in the primary cooling is excessively high, since the coating film is in a supercooled state, the coating film may be kept in a molten state, even at a temperature equal to or lower than the solidification temperature (about 340° C.). In addition, a high load may be applied to the manufacturing equipment in consideration of the capability of the equipment or the like. From these viewpoints, it is preferable that the cooling rate be 150° C./s or lower.

Heating

After primary cooling has been performed, heating is performed to a heating temperature of 280° C. or higher and 340° C. or lower.

We focused, in particular, on a Mg—Zn compound, and found that, by performing a heating treatment on a steel sheet having a Zn—Al—Mg-based coating film containing a $MgZn_2$ phase in a specified temperature range, phase transformation from a $MgZn_2$ phase into a $Mg_2Zn_{11}$ phase occurs. Although the mechanism by which the phase transformation from a $MgZn_2$ phase into a $Mg_2Zn_{11}$ phase occurs due to a heat treatment is not clear, we believe that solid-phase transformation into the most thermodynamically stable phase, that is, a $Mg_2Zn_{11}$ phase, occurs as a result of Mg diffusing from a $MgZn_2$ phase to an adjacent Zn phase.

It is necessary that the heating temperature be 280° C. or higher. When the heating temperature is lower than 280° C., since there is an increase in the time required for phase transformation from a $MgZn_2$ phase into a $Mg_2Zn_{11}$ phase, a sufficient amount of a $Mg_2Zn_{11}$ phase is not formed. Although when the heating temperature is higher than 340° C., the higher the heating temperature, the more promoted the phase transformation, since a ternary eutectic crystal of a Zn/Al/Mg—Zn compound in the coating film is melted, a $MgZn_2$ phase is crystallized when the secondary cooling is performed. When a $MgZn_2$ phase is crystallized, since a $Mg_2Zn_{11}$ phase is locally crystallized in subsequent manufacturing processes, black spots are generated, which has an undesirable effect on surface appearance. Therefore, the heating temperature is 280° C. or higher and 340° C. or lower, preferably 300° C. or higher and 340° C. or lower, or more preferably 320° C. or higher and 340° C. or lower.

Secondary Cooling

After the heating has been performed, secondary cooling, in which the coated steel sheet is cooled, is performed. There is no particular limitation on the secondary cooling stop temperature, and the secondary cooling stop temperature may be, for example, room temperature. Although there is no particular limitation on the cooling rate in the secondary cooling, it is preferable that the cooling rate be 10° C./s or higher from the viewpoint of productivity. It is preferable that the cooling rate be 150° C./s or lower in consideration of the capability of the manufacturing equipment.

The primary cooling stop temperature and the heating temperature refer to the surface temperature of the steel sheet. In addition, the heating rate, the primary cooling rate, and the secondary cooling rate are determined on the basis of the surface temperature of the steel sheet.

Moreover, when the heating temperature following the primary cooling is defined as A (° C.), and the time for which the steel sheet has a temperature of 250° C. or higher in the process from the heating following the primary cooling to the secondary cooling is defined as t (seconds), by satisfying relational expression (1) below, it is possible to manufacture a steel sheet having a Zn—Al—Mg-based coating film with improved surface appearance:

$$18 \leq \tfrac{1}{2} \times (A-250) \times t \leq 13500 \quad (1)$$

where A: heating temperature (° C.) following the primary cooling, and t: time (seconds) for which the steel sheet has a temperature of 250° C. or higher in the process from the heating following the primary cooling to the secondary cooling.

To stably achieve the desired X-ray diffraction peak intensity ratio, that is, a $MgZn_2/Mg_2Zn_{11}$ of 0.2 or less, it is preferable that (½×(A−250)×t) be 18 or more or more preferably 100 or more. On the other hand, it is preferable that (½×(A−250)×t) be 13500 or less. When (½×(A−250)×t) is more than 13500, since there is a coarsening of $Mg_2Zn_{11}$ due to the grain growth of $Mg_2Zn_{11}$ caused by an excessive heating treatment, there is a deterioration in blackening resistance. Therefore, it is preferable that (½×(A−250)×t) be 13500 or less or more preferably 8000 or less.

With the method described above, it is possible to obtain our steel sheet having a hot-dip Zn—Al—Mg-based coating film. There is no particular limitation on the coating weight. It is preferable that the coating weight per side be 10 g/m$^2$ or more from the viewpoint of corrosion resistance. It is preferable that the coating weight per side be 500 g/m$^2$ or less from the viewpoint of workability.

There is no particular limitation on the base steel sheet subjected to a hot-dip Zn—Al—Mg-based coating treatment. Any one of a hot-rolled steel sheet and a cold-rolled steel sheet may be used.

Moreover, to further improve corrosion resistance, the steel sheet having a hot-dip Zn—Al—Mg-based coating film may be further subjected to a chemical conversion treatment to form a chemical conversion coating film on the original coating film. Examples of an applicable chemical conversion coating film include an inorganic compound film, an organic resin film, and an inorganic compound-organic resin composite film. Examples of an inorganic compound include metal oxides and metal phosphates containing mainly titanium and vanadium. In addition, examples of an organic resin include an ethylene-based resin, an epoxybased resin, and a urethane-based resin. There is no particular limitation on the conditions applied to the chemical conversion treatment, and commonly known chemical conversion treatment conditions may be applied. That is, a chemical conversion coating film may be formed by applying a treatment solution containing an inorganic compound, an organic resin, or a mixture of an inorganic compound and an organic resin to the surface of the original coating film and by then drying the applied solution. It is preferable that the coating weight of the chemical conversion coating film be 0.1 $g/m^2$ or more and 10 $g/m^2$ or less. When the coating weight is less than 0.1 $g/m^2$, it may not be possible to achieve a sufficient effect of improving corrosion resistance. When the coating weight is more than 10 $g/m^2$, the effect of improving corrosion resistance becomes saturated.

In addition, the surface of the original coating film is not subjected to a chromate treatment.

Examples

Hereafter, our steel sheets and methods will be described in detail in accordance with examples. This disclosure is not limited to the examples described below.

By using a cold-rolled steel sheet having a thickness of 1.6 mm as a base steel sheet and by a continuous galvanizing line (CGL), steel sheets having a hot-dip Zn—Al—Mg-based coating film were manufactured under the conditions given in Table 1. The coating weight per side was 100 $g/m^2$.

For the steel sheets having a hot-dip Zn—Al—Mg-based coating film obtained as described above, the X-ray intensity ratio, that is, $MgZn_2/Mg_2Zn_{11}$, was determined, and surface appearance, corrosion resistance, and blackening resistance were evaluated. The measuring methods will be described in detail below.

X-ray diffraction peak intensity ratio: $MgZn_2/Mg_2Zn_{11}$

By measuring the coating film of the steel sheet having a hot-dip Zn—Al—Mg-based coating film manufactured as described above by X-ray diffractometry (θ-2θ diffraction method) under the following conditions, and by dividing the peak intensity for $MgZn_2$ (2θ=about 19.6°) by the peak intensity for $Mg_2Zn_{11}$ (2θ=about 14.6°), the X-ray diffraction peak intensity ratio, that is, $MgZn_2/Mg_2Zn_{11}$, was calculated.

X-Ray Diffractometry Conditions

X-ray radiation source: Cu-Kα ray (tube voltage: 40 kV, tube current: 50 mA)

Evaluation of Surface Appearance 10 samples having a width of 1000 mm and a length of 500 mm were taken at intervals of 100 m from the coil having a length of 1000 m of the steel sheet having a hot-dip Zn—Al—Mg-based coating film manufactured as described above, and whether or not black spots existed was investigated under the following conditions:

A: no black spot was visually identified

B: (one or more) black spots were visually identified.

A sample corresponding to A was judged as satisfactory, and a sample corresponding to B was judged as unsatisfactory.

Evaluation of Corrosion Resistance

By taking a test piece having a width of 70 mm and a length of 150 mm from the steel sheet having a hot-dip Zn—Al—Mg-based coating film manufactured as described above, by sealing the back surface and edges of the test piece with vinyl tape, and by performing an SST (salt spray test in accordance with JIS Z 2371) for 1000 hours, a difference in the weight of the steel sheet between before and after the test (corrosion weight loss) was evaluated. The evaluation criteria are as follows:

A: corrosion weight loss was less than 20 $g/m^2$

B: corrosion weight loss was 20 $g/m^2$ or more and less than 40 $g/m^2$

C: corrosion weight loss was 40 $g/m^2$ or more.

A sample corresponding to A or B was judged as satisfactory, and a sample corresponding to C was judged as unsatisfactory.

Evaluation of Blackening Resistance

By taking a test piece having a width of 50 mm and a length of 50 mm from the steel sheet having a hot-dip Zn—Al—Mg-based coating film manufactured as described above, and by exposing the test piece to an environment at a temperature of 40° C. and a humidity of 80% for 10 days, a difference in the L-value (lightness) of the test piece between before and after the test was determined by using a spectrophotometer. The L-value was determined in the SCI mode (including regular reflection light) by using an SQ 2000, produced by NIPPON DENSHOKU INDUSTRIES Co., LTD, and ΔL (=(L-value of the steel sheet before the test)−(L-value of the steel sheet after the test)) was calculated. The evaluation was performed on a 5-point scale as described below. A sample corresponding to any one of A through D was judged as satisfactory, and a sample corresponding to E was judged as unsatisfactory.

A: ΔL was 0 or more and less than 3

B: ΔL was 3 or more and less than 6

C: ΔL was 6 or more and less than 9

D: ΔL was 9 or more and less than 12

E: ΔL was 12 or more

The results obtained as described above are given in Table 1 along with the manufacturing conditions.

TABLE 1

| | Chemical Composition of Coating Bath | | | | Manufacturing Condition | | | | | | |
|---|---|---|---|---|---|---|---|---|---|---|---|
| | | | | | Coating Bath | Primary Coding | Primary Stop | Heating | Heating | Secondary Cooling | |
| No. | Al mass % | Mg mass % | Ni mass % | Si mass % | Temperature ° C. | Rate ° C./s | Temperature ° C. | Rate ° C./s | Temperature ° C. | Rate ° C./s | t (s) |
| 1 | 4 | 3 | — | — | 450 | 1 | 200 | 10 | 330 | 10 | 16 |
| 2 | 4 | 3 | — | — | 450 | 5 | 200 | 10 | 310 | 10 | 12 |
| 3 | 4 | 3 | — | — | 450 | 5 | 300 | 10 | 330 | 10 | 16 |
| 4 | 4 | 3 | — | — | 450 | 5 | 200 | 10 | 220 | 10 | 0 |
| 5 | 4 | 3 | — | — | 450 | 10 | 200 | 10 | 300 | 10 | 10 |
| 6 | 4 | 3 | — | — | 450 | 10 | 200 | 10 | 360 | 10 | 22 |
| 7 | 4 | 3 | — | — | 450 | 1 | — | — | — | — | — |
| 8 | 4 | 3 | — | — | 450 | 5 | — | — | — | — | — |
| 9 | 4 | 3 | — | — | 450 | 10 | — | — | — | — | — |
| 10 | 6 | 0.5 | — | — | 450 | 10 | 200 | 10 | 310 | 10 | 12 |
| 11 | 6 | 1 | — | — | 450 | 10 | 170 | 10 | 330 | 10 | 16 |

TABLE 1-continued

| | | | | | | | | | | | |
|---|---|---|---|---|---|---|---|---|---|---|---|
| 12 | 6 | 5 | — | — | 450 | 10 | 150 | 10 | 320 | 10 | 14 |
| 13 | 10 | 0.5 | — | — | 450 | 10 | 180 | 10 | 300 | 10 | 10 |
| 14 | 10 | 1 | — | — | 450 | 10 | 110 | 10 | 330 | 10 | 16 |
| 15 | 10 | 5 | — | — | 450 | 10 | 150 | 10 | 330 | 10 | 16 |
| 16 | 15 | 0.5 | — | — | 450 | 10 | 190 | 10 | 310 | 10 | 12 |
| 17 | 15 | 1 | — | — | 450 | 10 | 180 | 10 | 300 | 10 | 10 |
| 18 | 15 | 5 | — | — | 450 | 10 | 200 | 10 | 320 | 10 | 14 |
| 19 | 1 | 0.2 | — | — | 450 | 5 | 200 | 50 | 335 | 20 | 6 |
| 20 | 1 | 1 | 0.1 | — | 460 | 3 | 250 | 20 | 339 | 10 | 13 |
| 21 | 2 | 1.5 | — | 0.2 | 465 | 5 | 250 | 20 | 330 | 20 | 8 |
| 22 | 3 | 2.5 | — | — | 460 | 10 | 200 | 10 | 320 | 10 | 14 |
| 23 | 4 | 2.5 | — | — | 460 | 10 | 200 | 10 | 320 | 10 | 14 |
| 24 | 4 | 0.5 | 0.08 | — | 460 | 10 | 200 | 10 | 330 | 10 | 16 |
| 25 | 4 | 2 | — | 0.01 | 460 | 5 | 200 | 10 | 310 | 10 | 12 |
| 26 | 4 | 3.8 | — | — | 470 | 15 | 250 | 5 | 320 | 5 | 28 |
| 27 | 4 | 2.8 | 0.1 | 0.1 | 470 | 5 | 200 | 10 | 330 | 10 | 16 |
| 28 | 4.5 | 6.5 | 0.05 | — | 470 | 50 | 200 | 1 | 330 | 1 | 178 |
| 29 | 5 | 0.6 | — | — | 465 | 5 | 250 | 20 | 339 | 20 | 9 |
| 30 | 5 | 3 | — | — | 465 | 5 | 250 | 10 | 338 | 10 | 18 |
| 31 | 5 | 5 | — | — | 465 | 5 | 250 | 3 | 338 | 3 | 59 |
| 32 | 5 | 6 | — | — | 465 | 5 | 250 | 1 | 338 | 1 | 176 |
| 33 | 5 | 10 | — | — | 465 | 5 | 250 | 0.6 | 338 | 0.6 | 293 |
| 34 | 6 | 2.8 | — | — | 460 | 5 | 100 | 0.1 | 319 | 0.1 | 1380 |
| 35 | 6 | 2.5 | 0.2 | — | 460 | 20 | 150 | 20 | 335 | 20 | 9 |
| 36 | 6 | 2.8 | — | — | 460 | 10 | — | — | — | — | — |
| 37 | 6.5 | 2.1 | — | — | 465 | 15 | 325 | 20 | 337 | 20 | 9 |
| 38 | 6.5 | 9.8 | — | — | 460 | 50 | 150 | 1 | 338 | 1 | 176 |
| 39 | 7.5 | 1.5 | — | — | 465 | 10 | 350 | 10 | 370 | 20 | 18 |
| 40 | 8 | 0.5 | — | — | 450 | 5 | 150 | 10 | 250 | 10 | 0 |
| 41 | 9 | 2 | 0.02 | 0.5 | 465 | 10 | 170 | 25 | 330 | 15 | 9 |
| 42 | 10.5 | 2.6 | — | 0.3 | 455 | 10 | 150 | 10 | 320 | 10 | 14 |
| 43 | 11 | 0.5 | — | — | 460 | 5 | — | — | — | — | — |
| 44 | 11.5 | 2.5 | — | — | 450 | 10 | 110 | 20 | 330 | 20 | 8 |
| 45 | 13 | 0.5 | — | — | 470 | 10 | 150 | 10 | 330 | 10 | 16 |
| 46 | 13 | 1.5 | 0.15 | — | 465 | 15 | 190 | 50 | 325 | 20 | 5 |
| 47 | 15 | 2.5 | | — | 460 | 10 | 200 | 10 | 320 | 10 | 14 |
| 48 | 16 | 2.5 | | — | 460 | 10 | 200 | 10 | 320 | 10 | 14 |
| 49 | 16 | 0.05 | 0.09 | — | 450 | 15 | 200 | 15 | 320 | 50 | 6 |
| 50 | 18.5 | 1 | — | — | 460 | 20 | 110 | 50 | 330 | 20 | 6 |
| 51 | 20.5 | 0.1 | — | 2 | 455 | 20 | 190 | 30 | 310 | 10 | 8 |
| 52 | 22 | 1 | — | — | 465 | 15 | 180 | 30 | 300 | 10 | 7 |
| 53 | 22 | 1.5 | — | 0.05 | 460 | 15 | 150 | 20 | 360 | 10 | 17 |
| 54 | 22 | 2.8 | 0.005 | — | 470 | 10 | 180 | 20 | 300 | 10 | 8 |

| | Manufacturing | Chemical Composition of Coating Film | | | | Evaluation Result | | | | |
|---|---|---|---|---|---|---|---|---|---|---|
| | | | | | | X-ray Diffraction Peak | Surface | Corrosion | Blackening | |
| No. | Condition 1/2 × (A-250) × t | Al mass % | Mg mass % | Ni mass % | Si mass % | Intensity Ratio $MgZr_2/Mg_2Zn_{11}$ | Appearance *1 | Resistance *2 | Resistance *3 | Note |
| 1 | 640 | 4 | 3 | — | — | 0.05 | A | A | B | Example |
| 2 | 360 | 4 | 3 | — | — | 0.07 | A | A | B | Example |
| 3 | 640 | 4 | 3 | — | — | 0.9 | B | C | B | Comparative Example |
| 4 | 90 | 4 | 3 | — | — | 1.1 | B | C | B | Comparative Example |
| 5 | 250 | 4 | 3 | — | — | 0.08 | A | A | B | Example |
| 6 | 1210 | 4 | 3 | — | — | 0.8 | B | C | B | Comparative Example |
| 7 | — | 4 | 3 | — | — | 0.8 | B | C | B | Comparative Example |
| 8 | — | 4 | 3 | — | — | 0.9 | B | C | B | Comparative Example |
| 9 | — | 4 | 3 | — | — | 20 | B | C | B | Comparative Example |
| 10 | 360 | 6 | 0.5 | — | — | 0.05 | A | A | B | Example |
| 11 | 640 | 6 | 1 | — | — | 0.03 | A | A | B | Example |
| 12 | 490 | 6 | 5 | — | — | 0.04 | A | A | C | Example |
| 13 | 250 | 10 | 0.5 | — | — | 0.06 | A | A | B | Example |
| 14 | 640 | 10 | 1 | — | — | 0.02 | A | A | B | Example |
| 15 | 640 | 10 | 5 | — | — | 0.03 | A | A | B | Example |
| 16 | 360 | 15 | 0.5 | — | — | 0.04 | A | A | B | Example |
| 17 | 250 | 15 | 1 | — | — | 0.07 | A | A | B | Example |
| 18 | 490 | 15 | 5 | — | — | 0.05 | A | A | C | Example |
| 19 | 253 | 1 | 0.2 | — | — | 0.03 | A | B | B | Example |
| 20 | 594 | 1 | 1 | 0.1 | — | 0.08 | A | B | A | Example |
| 21 | 320 | 2 | 1.5 | — | 0.2 | 0.04 | A | B | B | Example |

TABLE 1-continued

| | | | | | | | | | | |
|---|---|---|---|---|---|---|---|---|---|---|
| 22 | 490 | 3 | 2.5 | — | — | 0.08 | A | B | B | Example |
| 23 | 490 | 4 | 2.5 | — | — | 0.07 | A | A | B | Example |
| 24 | 640 | 4 | 0.5 | 0.08 | — | 0.05 | A | A | A | Example |
| 25 | 360 | 4 | 2 | — | 0.01 | 0.07 | A | A | B | Example |
| 26 | 980 | 4 | 3.8 | — | — | 0.06 | A | A | B | Example |
| 27 | 640 | 4 | 2.8 | 0.1 | 0.1 | 0.06 | A | A | A | Example |
| 28 | 7921 | 4.5 | 6.5 | 0.05 | — | 0.15 | A | A | A | Example |
| 29 | 387 | 5 | 0.6 | — | — | 0.02 | A | A | B | Example |
| 30 | 774 | 5 | 3 | — | — | 0.05 | A | A | B | Example |
| 31 | 2581 | 5 | 5 | — | — | 0.15 | A | A | B | Example |
| 32 | 7744 | 5 | 6 | — | — | 0.18 | A | A | B | Example |
| 33 | 12907 | 5 | 10 | — | — | 0.16 | A | A | B | Example |
| 34 | 47610 | 6 | 2.8 | — | — | 0.08 | A | A | D | Example |
| 35 | 361 | 6 | 2.5 | 0.2 | — | 0.04 | A | A | A | Example |
| 36 | — | 6 | 2.8 | — | — | 32 | B | C | B | Comparative Example |
| 37 | 378 | 6.5 | 2.1 | — | — | 28 | B | C | B | Comparative Example |
| 38 | 7744 | 6.5 | 9.8 | — | — | 0.18 | A | A | C | Example |
| 39 | 1080 | 7.5 | 1.5 | — | — | 35 | B | C | B | Comparative Example |
| 40 | 0 | 8 | 0.5 | — | — | 22 | B | C | B | Comparative Example |
| 41 | 341 | 9 | 2 | 0.02 | 0.5 | 0.03 | A | A | A | Example |
| 42 | 490 | 10.5 | 2.6 | — | 0.3 | 0.04 | A | A | B | Example |
| 43 | — | 11 | 0.5 | — | — | 32 | B | C | B | Comparative Example |
| 44 | 320 | 11.5 | 2.5 | — | — | 0.02 | A | A | B | Example |
| 45 | 640 | 13 | 0.5 | — | — | 0.03 | A | A | B | Example |
| 46 | 197 | 13 | 1.5 | 0.15 | — | 0.04 | A | A | A | Example |
| 47 | 490 | 15 | 2.5 | — | — | 0.06 | A | A | B | Example |
| 48 | 490 | 16 | 2.5 | — | — | 0.09 | A | B | B | Example |
| 49 | 212 | 16 | 0.05 | 0.09 | — | 0.05 | A | B | A | Example |
| 50 | 224 | 18.5 | 1 | — | — | 0.02 | A | B | B | Example |
| 51 | 240 | 20.5 | 0.1 | — | 2 | 0.04 | A | B | B | Example |
| 52 | 167 | 22 | 1 | — | — | 0.07 | A | B | B | Example |
| 53 | 908 | 22 | 1.5 | — | 0.05 | 46 | B | C | B | Comparative Example |
| 54 | 188 | 22 | 2.8 | 0.005 | — | 0.07 | A | B | A | Example |

*1: A: no black spot was visually identified
B: (one or more) black spots were visually identified
*2: A: corrosion weight loss was less than 20 g/m$^2$
B: corrosion weight loss was 20 g/m$^2$ or more and less than 40 g/m$^2$
C: corrosion weight loss was 40 g/m$^2$ or more
*3: A: ΔL was 0 or more and less han 3
B: ΔL was 3 or more and less than 6
C: ΔL was 6 or more and less than 9
D: ΔL was 9 or more and less than 12
E: ΔL was 12 or more It is clarified that, in our Examples, that is, Nos. 1, 2, 5, 10 through 35, 38, 41, 42, 44 through 52, and 54, the X-ray diffraction peak intensity ratio of a Mg—Zn compound forming the coating film, that is, $MgZn_2/Mg_2Zn_{11}$, was 0.2 or less and that steel sheets having a hot-dip Zn—Al—Mg-based coating film excellent in terms of corrosion resistance and surface appearance without black spots were obtained.

In Comparative Example Nos. 7, 8, 9, 36, and 43 where the heat treatment was not performed, since $Mg_2Zn_{11}$ was not formed, the X-ray intensity ratio was more than 0.2, and both surface appearance and corrosion resistance were poor.

In the Comparative Examples other than those described above, since at least one of the manufacturing conditions was out of our range, at least one of surface appearance and corrosion resistance was poor.

INDUSTRIAL APPLICABILITY

Our steel sheet having a hot-dip Zn—Al—Mg-based coating film is excellent in terms of surface appearance and can be used for a wide range of industrial fields including automobiles, electrical appliances, and building materials.

The invention claimed is:

1. A method of manufacturing a steel sheet having a hot-dip Zn-Al-Mg-based coating film and blackening resistance, comprising:

dipping a base steel sheet in a coating bath containing 1 mass % to 22 mass % of Al and 0.1 mass % to 10 mass % of Mg to form a hot-dip Zn-Al-Mg-based coating film, performing primary cooling on the steel sheet coated with the hot-dip Zn-Al-Mg-based coating film to a primary cooling stop temperature of lower than 300° C. such that the coating film is completely solidified so that a $MgZn_2$ phase in the coating film is crystallized, heating the cooled steel sheet to a heating temperature of 280° C. or higher and 340° C. or lower to obtain an X-ray diffraction peak intensity ratio of a Mg—Zn compound phase in the coating film, $MgZn_2/Mg_2Zn_{11}$, of 0.2 or less to provide the blackening resistance, and performing secondary cooling on the heated steel sheet, wherein, during the heating and the secondary cooling, the steel sheet has a temperature of 250° C. or higher for time t defined by Equation (1)

$$18 \leq \frac{1}{2} \times (A-250) \times t \leq 13500 \quad (1)$$

where A: heating temperature (° C.) following the primary cooling and t: time (seconds) for which the steel sheet has a temperature of 250° C. or higher in a process from the heating following the primary cooling to the secondary cooling.

2. The method according to claim 1, wherein the primary cooling stop temperature is 200° C. or lower, and the heating temperature is 300° C. or higher and 340° C. or lower.

3. The method according to claim 2, wherein the coating bath further contains 0.005 mass % to 0.25 mass % of Ni.

4. The method according to claim 3, further comprising:

performing a chemical conversion treatment after the secondary cooling has been performed to form any one of an inorganic compound-based film, an organic resin-based film, and an inorganic compound-organic resin composite film on a surface of the coating film.

5. The method according to claim 2, further comprising:

performing a chemical conversion treatment after the secondary cooling has been performed to form any one of an inorganic compound-based film, an organic resin-based film, and an inorganic compound-organic resin composite film on a surface of the coating film.

6. The method according to claim 1, wherein the coating bath further contains 0.005 mass % to 0.25 mass % of Ni.

7. The method according to claim 6, further comprising:

performing a chemical conversion treatment after the secondary cooling has been performed to form any one of an inorganic compound-based film, an organic resin-based film, and an inorganic compound-organic resin composite film on a surface of the coating film.

8. The method according to claim 1 further comprising:

performing a chemical conversion treatment after the secondary cooling has been performed to form any one of an inorganic compound-based film, an organic resin-based film, and an inorganic compound-organic resin composite film on a surface of the coating film.

* * * * *